US012618318B2

(12) United States Patent
Husband et al.

(10) Patent No.: US 12,618,318 B2
(45) Date of Patent: May 5, 2026

(54) ROBOTIC SYSTEMS AND ASSOCIATED AUTOMATED WELL COMPLETION OPERATIONS

(71) Applicant: Nabors Drilling Technologies USA, Inc., Houston, TX (US)

(72) Inventors: Frank J. Husband, Galveston, TX (US); Malini Manocha, Cypress, TX (US); Colin Oliver, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 18/817,772

(22) Filed: Aug. 28, 2024

(65) Prior Publication Data

US 2025/0075608 A1 Mar. 6, 2025

Related U.S. Application Data

(60) Provisional application No. 63/579,796, filed on Aug. 30, 2023.

(51) Int. Cl.
*E21B 44/00* (2006.01)
*E21B 43/26* (2006.01)

(52) U.S. Cl.
CPC ..... *E21B 44/00* (2013.01); *E21B 43/26* (2013.01); *E21B 2200/20* (2020.05)

(58) Field of Classification Search
CPC ..... E21B 44/00; E21B 43/26; E21B 2200/20
USPC ..... 175/24
See application file for complete search history.

(56) References Cited

U.S. PATENT DOCUMENTS

| | | | | |
|---|---|---|---|---|
| 6,056,071 | A * | 5/2000 | Scott | E21B 7/12 175/85 |
| 9,051,782 | B2 * | 6/2015 | Magnuson | E21B 15/003 |
| 10,400,536 | B2 | 9/2019 | Seshadri et al. | |
| 11,815,083 | B2 | 11/2023 | Mu et al. | |
| 11,946,352 | B2 | 4/2024 | Christie et al. | |
| 2018/0230782 | A1 * | 8/2018 | Pankaj | G01V 1/282 |
| 2018/0230784 | A1 * | 8/2018 | Rodriguez Herrera | E21B 41/00 |
| 2018/0258719 | A1 * | 9/2018 | Orban | B28C 7/0418 |

(Continued)

FOREIGN PATENT DOCUMENTS

EP 2 884 043 A2 6/2015

OTHER PUBLICATIONS

International Search Report and Written Opinion; International Application No. PCT/US2024/044309; International Filing Date Aug. 29, 2024; Date of Mailing Oct. 30, 2024; 10 pages.

*Primary Examiner* — Nicole Coy
*Assistant Examiner* — Douglas S Wood
(74) *Attorney, Agent, or Firm* — Haynes and Boone, LLP

(57) ABSTRACT

A method of using dual-use pump systems to reduce greenhouse emissions and completion costs that includes positioning a first pump system ("FPS") and a drilling apparatus ("DA") at a first well pad and a second pump system ("SPS") at a second well pad. The method includes performing a drilling operation using the FPS and the DA on at the first well pad, and then moving the DA to the second well pad to couple with the SPS. A completion unit is then coupled to the FPS at the first well pad. While the DA performs a drilling operation using the SPS at the second well pad, the completion unit performs a completion operation using the FPS at the first well pad.

22 Claims, 10 Drawing Sheets

(56) References Cited

U.S. PATENT DOCUMENTS

| | | | | |
|---|---|---|---|---|
| 2018/0355707 | A1* | 12/2018 | Rodriguez Herrera | G01V 1/50 |
| 2019/0003329 | A1* | 1/2019 | Morris | E21B 41/0085 |
| 2019/0093433 | A1 | 3/2019 | Aguirre et al. | |
| 2019/0178079 | A1* | 6/2019 | Falk | E21B 49/10 |
| 2019/0211664 | A1* | 7/2019 | Billingham | E21B 23/14 |
| 2022/0056799 | A1* | 2/2022 | Johnson | E21B 44/00 |

* cited by examiner

ROBOTIC SYSTEMS AND ASSOCIATED AUTOMATED WELL COMPLETION OPERATIONS

CROSS-REFERENCE TO RELATED APPLICATION

This application claims the benefit of the filing date of, and priority to, U.S. Patent Application No. 63/579,796, filed Aug. 30, 2023, the entire disclosure of which is hereby incorporated herein by reference.

TECHNICAL FIELD

This disclosure relates in general to systems and related methods for well stimulation, and specifically to using an automated sequence to stimulate a reservoir using dual-use pumping system(s).

BACKGROUND

Modern high-volume hydraulic well stimulation is a technique used to enable the extraction of natural gas or oil from shale and other forms of "tight" rock, or impermeable rock formations that lock in oil and gas and make fossil fuel production difficult. Large quantities of water, chemicals, and sand are injected into these formations at pressures high enough to crack the rock, allowing the once-trapped gas and oil to flow to the surface. With conventional systems, hydraulic well stimulation requires an extensive amount of equipment, such as high-pressure, high-volume well stimulation pumps; blenders for well stimulation fluids; and storage tanks for water, sand, chemicals, and wastewater. This stimulation infrastructure, along with other additional equipment, conventionally arrives at drill sites via heavy trucks. With conventional systems, the stimulation infrastructure arrives on site and replaces the drilling infrastructure after the drilling infrastructure has been removed; therefore, both sets of infrastructure are not in operation on the well pad at the same time. This sequence of drilling infrastructure being removed before stimulation infrastructure is set in place is, at least in part, due to space limitations on the well pad. Conventionally, the footprint associated with conventional stimulation infrastructure is too large to share the well pad with the drilling infrastructure. Waiting to set up the stimulation infrastructure until the drilling infrastructure is removed limits the number of wells that can be completed in a time period, such as for example a year. Moreover, the use of heavy trucks and personnel associated with the delivery and set up of the conventional stimulation infrastructure can introduce greenhouse gas emissions and increase the risk of personnel injuries, etc.

Therefore, what is needed is a system, method, or apparatus that addresses one or more of the foregoing issues, and/or one or more other issues.

DETAILED DESCRIPTION

Figure 1:
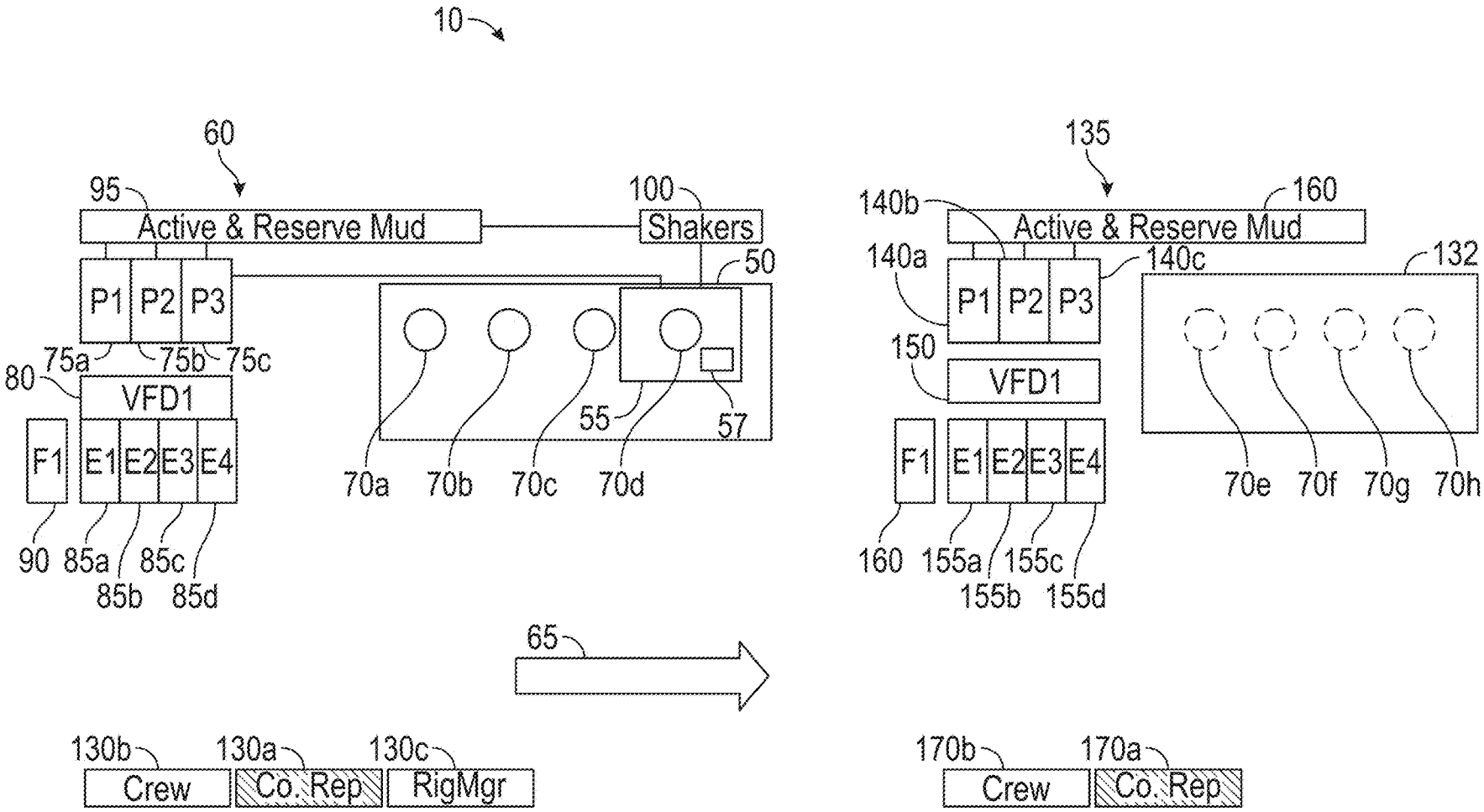
FIG. 1 is a schematic diagram of well pads upon which a portion of a drilling and completion system is in a first configuration, wherein the system comprises a first computing device, according to one or more aspects of the present disclosure.

The following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

A drilling and completion system, an example of which is illustrated in FIG. 1, provides improvements to conventional hydraulic well stimulation apparatuses and methods. Some example improvements are associated with the use of a dual-use pump system that is configured to switch between drilling operations and stimulation operations. In some embodiments, a dual-use pump system is configured to implement instructions associated with a drilling operation and then implement instructions associated with a stimulation operation while remaining in the same location. The use of a dual-use pump system eliminates the need for the conventional stimulation infrastructure, such as the high-pressure, high-volume well stimulation pumps that arrive via heavy trucks, and its large footprint. Moreover, and in some embodiments, the use of a dual-user pump system reduces costs due to fewer man-hours spent driving and on location. The reduction of personnel on-site and driving also increases safety for the workers, which is an example safety improvement. Other example improvements are associated with the ability of the dual-use pump system to form a closed-loop feedback control system that is used to automate stimulation operations.

FIG. 1 is a schematic top view of a portion of a drilling and completion system 10 in a first configuration. FIG. 1 illustrates a first well pad 50 upon which a drilling apparatus 55 is positioned. The drilling apparatus 55 is or includes a land-based drilling rig and includes a computing device 57. An example first pump system 60 is operably connected to the drilling apparatus 55. FIG. 1 also includes an arrow 65 that illustrates a direction of movement of the drilling apparatus 55 across the first well pad 50. The well pad 50 includes a series of wells such as wells 70*a*, 70*b*, 70*c*, and 70*d*. As illustrated, the first pump system 60 includes a plurality of mud pumps, such as mud pump 75*a*, 75*b*, and 75*c*; a variable-frequency drive 80 that is operably coupled to engines such as engine 85*a*, 85*b*, 85*c*, and 85*d*; fuel storage 90; and mud tank(s) 95 that are operably coupled to shakers 100. As illustrated, the first pump system 60 is operably coupled to the drilling apparatus 55 and the well 70*d* that is being drilled using the drilling apparatus 55. In this example, the mud pumps 75*a*, 75*b*, and 75*c* are configured to deliver drilling fluid to the drill string and receive drilling fluid from an annulus formed between the drill string and the wellbore. FIG. 1 also illustrates a company man trailer 130*a*, crew quarters structures 130*b*, and rig manager structure 130*c* associated with the wells 70*a*-70*d*. Further, FIG. 1 illustrates a second well pad 132 that includes a series of wells 70*c*, 70*f*, 70*g*, and 70*h*. A second pump system 135 is positioned proximate to the second well pad 132 to support drilling operations of the wells 70*c*-70*h*. In some embodiments, the pump system 135 is located in an additional backyard, which is deployed to the second well pad 132 that is different than the first well pad 50. Similar to the first pump system 60, the second pump system 135 includes a plurality of mud pumps, such as mud pump 140*a*, 140*b*, and 140*c*; a variable-frequency drive 150 that is operably coupled to engines such as engine 155*a*, 155*b*, 155, and 155*d*; fuel storage 160; and mud tank(s) 165. In some embodiments, drilling operations at the second well pad 132 is subsequent to the drilling operations at the first well pad 50. FIG. 1 also illustrates a company man trailer 170*a* and crew quarters structures 170*b* associated with the wells 70*e*-70*h*. While the drilling apparatus 55 is illustrated as positioned over the well 70*d* in the first configuration illustrated in FIG. 1, the drilling and completion system 10 is also in the first configuration when the apparatus 55 is positioned over each of the wells 70*a*, 70*b*, and 70*c*, which are associated with the first well pad 50. As noted above and when in the first configuration, the first pump system 60 is operably connected to the drilling apparatus 55 such that a controller 190 (FIG. 2) controls the first pump system 60 while drilling operations are being performed on one of the wells 70*a*, 70*b*, 70*c*, and 70*d*. In some embodiments and when the drilling and completion system 10 is in the first configuration, the second pump system 135 is positioned near the wells 70*c*, 70*f*, 70*g*, and 70*h* and is waiting to be operably coupled to the drilling apparatus 55 when the drilling apparatus is moved to the second well pad 132 to perform drilling operations on the wells 70*c*, 70*f*, 70*g*, and 70*h*.

Figure 2:
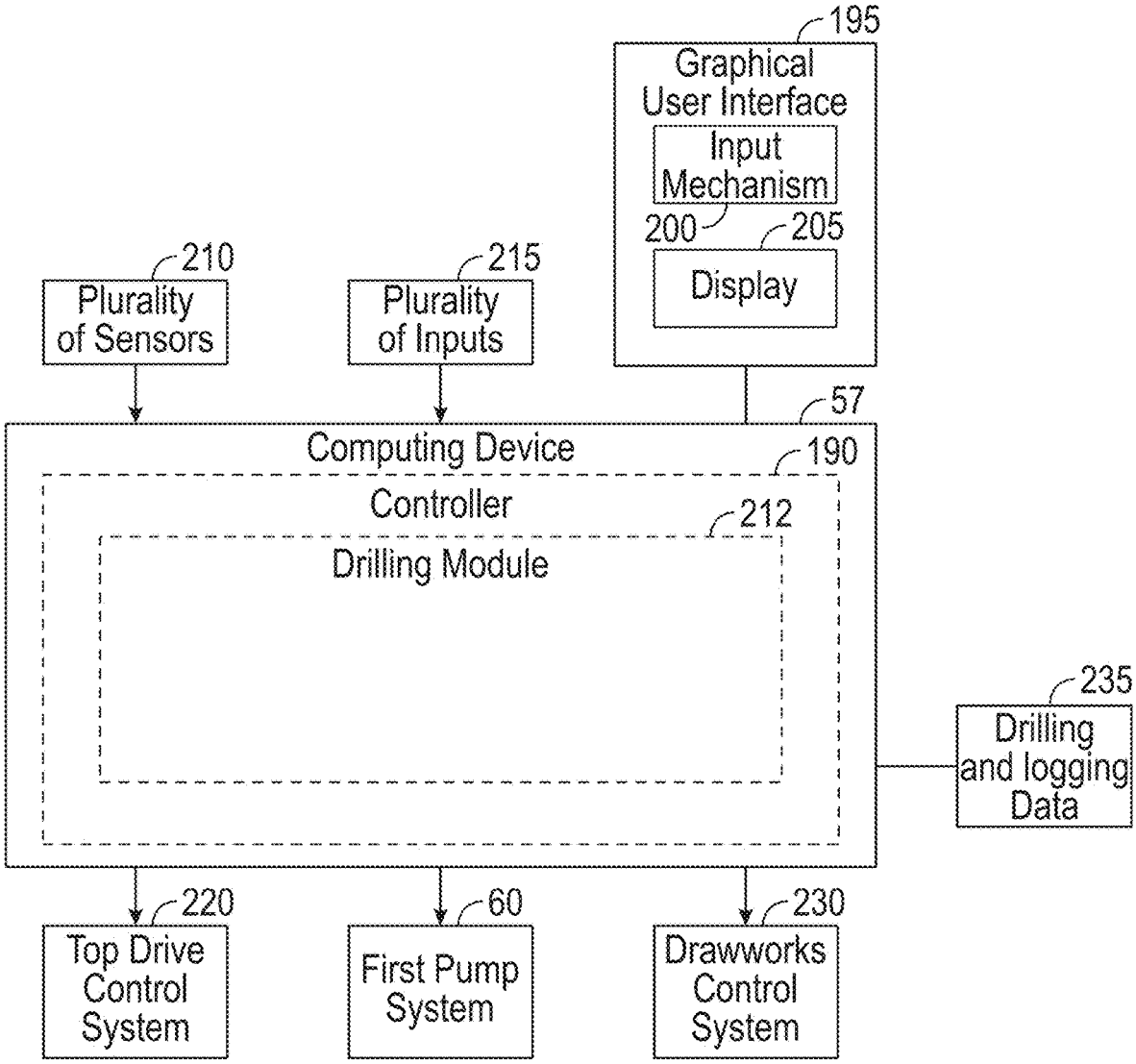
FIG. 2 is a schematic diagram of the first computing device of FIG. 1, according to one or more aspects of the present disclosure.

FIG. 2 is a diagrammatic illustration of a data flow involving at least a portion of the drilling apparatus 55, according to one or more embodiments. As illustrated in FIG. 2, the controller 190 is, includes, or is part of the computing device 57, but in other embodiments the controller 190 is distinct from, but operably coupled to, the computing device 57. Generally, the computing device 57 is also operably coupled to or includes a graphical user interface ("GUI") 195. The GUI 195 includes an input mechanism 200 for user-inputs or drilling parameters. Such input mechanism 200 may support data input from local and/or remote locations. The GUI 195 may also include a display 205 for visually presenting information to the user in textual, graphic, or video form. A drilling module 212 may be stored in the controller 190. The drilling module 212 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The drilling module 212 generally implements the task of completing a steering operation, which steers a bottom hole assembly ("BHA") along the planned drilling path; recommends and executes the addition of another stand to the drill string; recommends and executes the process of tripping out the BHA; among other operations.

Generally, the instructions for executing a task are based on a plurality of rules. Using the data provided from the plurality of inputs and referencing the plurality of rules, the drilling module 212 can generate instructions that address trends in the data and keep the drilling operation within tolerances and/or windows. The controller 190 is also configured to: receive a plurality of inputs 215 from a user via the input mechanism 200; and/or look up a plurality of inputs from a database. In some embodiments, the plurality of inputs 215 includes the well plan input, a maximum weight on bit ("WOB") input, a top drive input, a draw works input, a pump input (e.g., mud pump or proppant pump), best practices input, operating parameters, and equipment identification input, etc.

The computing device 57 and the controller 190 are also in communication with, or communicatively coupled to, a plurality of sensors 210. In one or more embodiments, the plurality of sensors 210 are associated with the drilling apparatus 55 and provide feedback on the drilling operation to the controller 190. The controller 190 and/or the drilling module 212 is configured to receive the feedback or other data from the plurality of sensors 210 and to adjust the workflow to maintain optimal execution of the drilling operation. In one or more embodiments, the plurality of sensors 210 may provide feedback or data on an angle or direction of the drill bit, fluid and gas pressures within the wellbore, the drilling apparatus 55, and the associated equipment, including the first pump system 60. In one or more embodiments the plurality of sensors 210 monitor conditions including: well depth, WOB, rotary speed, rotary torque, pump pressure, pump rate, fluid-flow rate, flow return rate and volume, rate of penetration, hookload, fluid properties (e.g., density, temperature, viscosity, compositions and contamination), and pit level.

As illustrated in FIG. 2, the controller 190 is also in communication with, or communicatively coupled to, a top drive control system 220, the first pump system 60, and a draw works control system 230. In some embodiments, the top drive control system 220 includes a top drive, a speed sensor, a torque sensor, and a hook load sensor associated with a hook. The top drive control system 220 is not required to include the top drive, but instead may include other drive systems, such as a power swivel, a rotary table, a coiled tubing unit, a downhole motor, and/or a conventional rotary rig, among others. In some embodiments, the draw works control system 230 includes a draw works controller and/or other means for controlling the feed-out and/or feed-in of the drilling line. Such control may include rotational control of the draw works (in v. out) to control the height or position of the hook and may also include control of the rate the hook ascends or descends. In some embodiments, at least a portion of the data generated during a drilling operation is drilling data and logging data 235, which can be saved by the drilling module 212 or another module for future use.

Figure 3A:
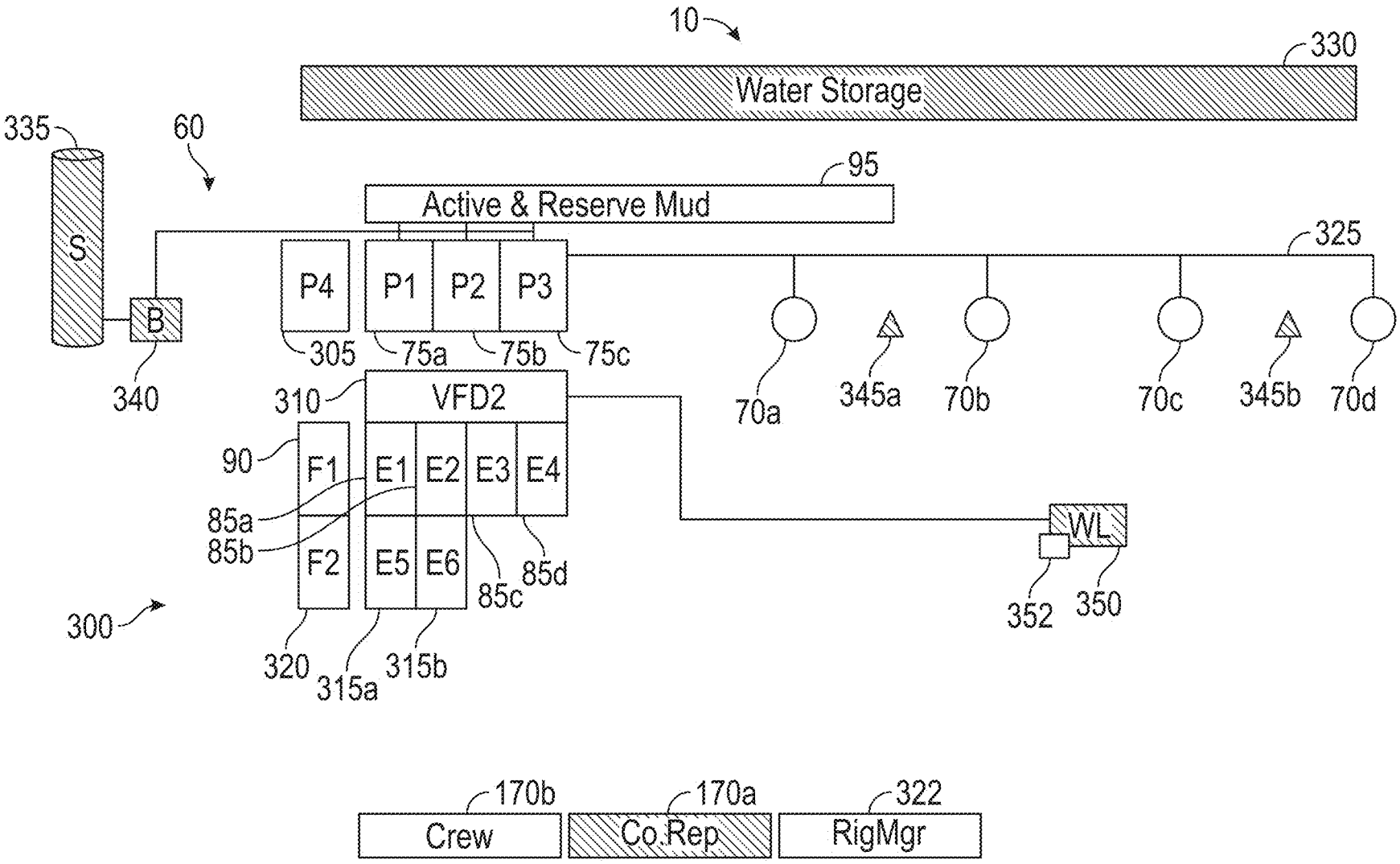
FIGS. 3A and 3B together illustrate a schematic diagram of the well pads of FIG. 1 upon which the drilling and completion system is in a second configuration, wherein the system comprises a second computing device, according to one or more aspects of the present disclosure.
Figure 3B:
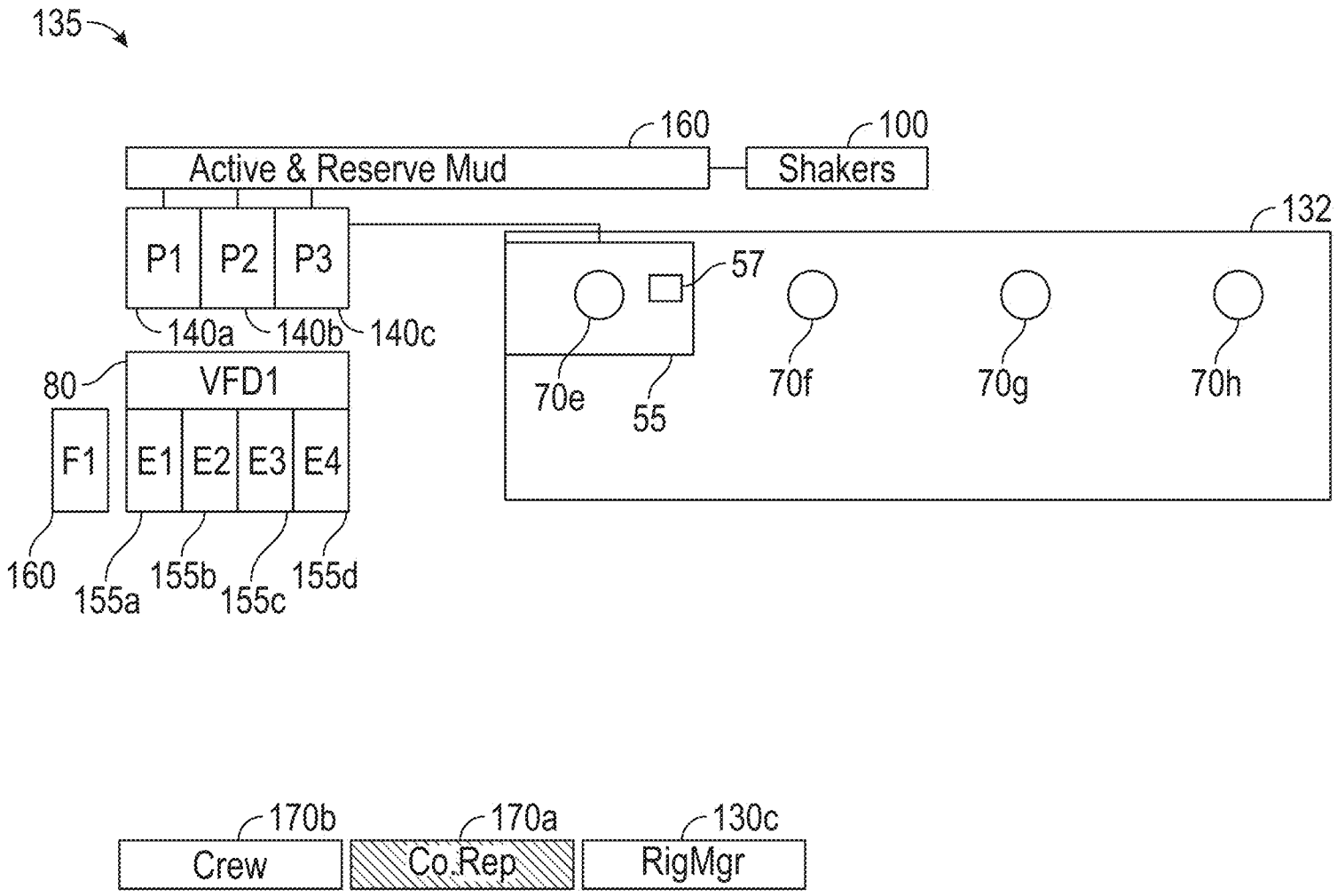

FIGS. 3A and 3B together illustrate a schematic top view of a portion of a drilling and completion system 10 in a second configuration. In the second configuration, and as illustrated, the drilling apparatus 55, the shaker 100, the variable-frequency drive 80, and the rig manager 130*c* are located near or proximate to the second well pad 132 such that the shaker 100 is operably coupled to the mud system 135 the drilling apparatus 55 is performing drilling operations on one of the wells 70*e*-70*h* (illustrated with drilling apparatus 55 performing drilling operations on well 70*e* in FIG. 3B), and the variable frequency drive 80 is operably coupled to engines such as engine 155*a*, 155*b*, 155*c*, and 155*d*. In the second configuration, the drilling and completion system 10 includes a completion unit 300 operably coupled to the first pump system 60 to convert the first pump system 60 into a portion of the completion unit 300. In some embodiments, the completion unit 300 includes mud pump(s), such as mud pump 305, variable-frequency drive (s), such as VRD 310, and engine(s) such as engines 315*a* and 315*b*, fuel storage 320, and a rig manager structure 322. The mud pump 305 is operably coupled to the mud tank(s) 95. In the second configuration, a zipper manifold 325 is connected to the wells 70*a*-70*d*, water storage 330, sand storage 335, and a blender 340 are positioned proximate the mud system 60. Crane 345*a* is positioned between well 70*a* and 70*b* and crane 345*b* is positioned between well 70*c* and 70*d*. A wireline unit 350 is operably coupled to the first pump system 60 and the completion unit 300. In some embodiments, the completion unit 300 includes the wireline unit 350. The completion unit 300 also includes a computing device 352 that is operably coupled to the wireline unit 350. While the computing device 352 is positioned near the wireline unit 350 in FIG. 3A, the computing device 352 and a graphical user interface for interacting with the computing device 352 may be located within the rig manager office 332 and/or the variable-frequency drive 310.

Figure 4:
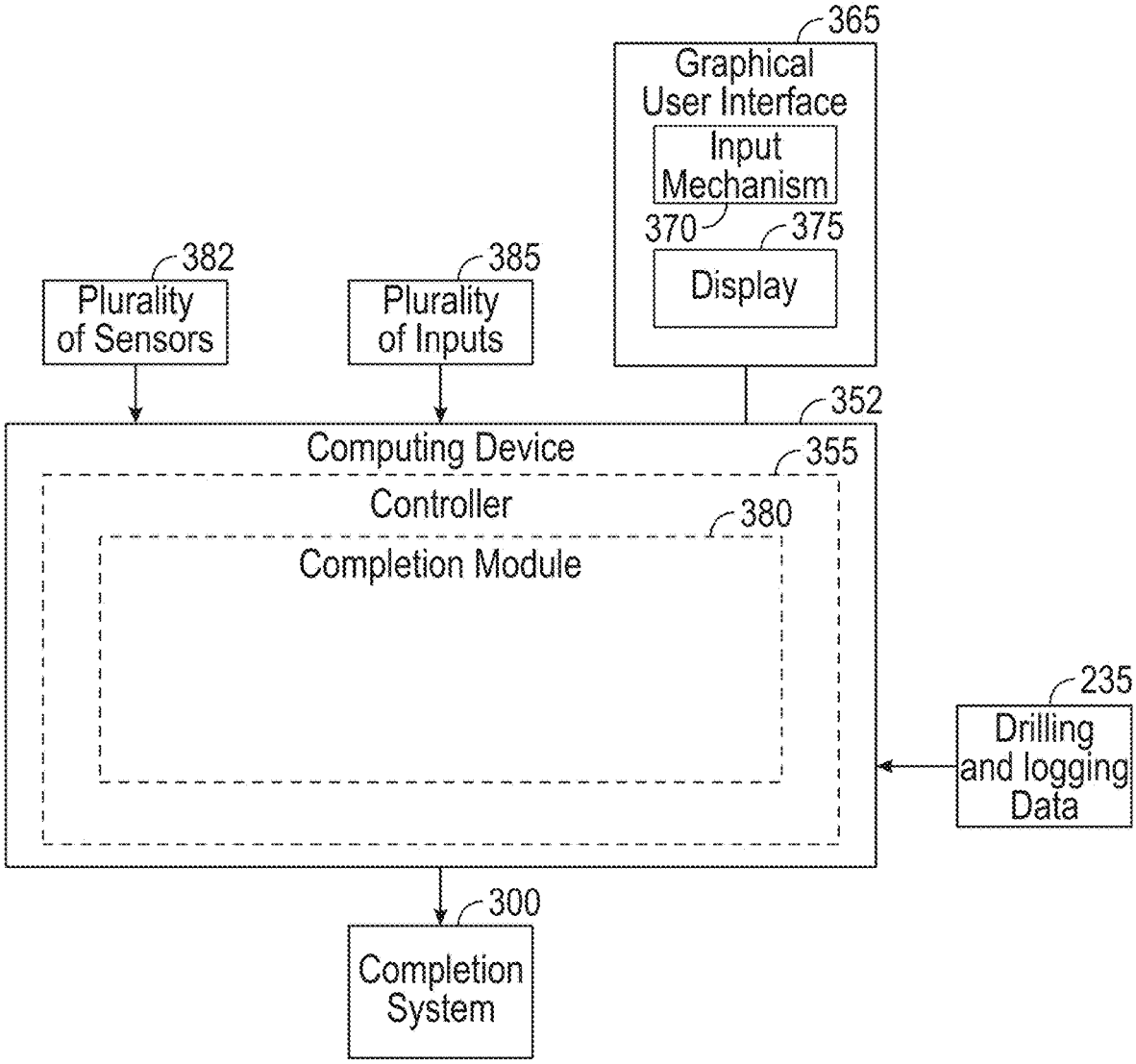
FIG. 4 is a schematic diagram of the second computing device of FIG. 3, according to one or more aspects of the present disclosure.

FIG. 4 is a diagrammatic illustration of a data flow involving at least a portion of the completion unit 300, according to one or more embodiments. As illustrated in FIG. 4, the computing device 352 is, includes or is part of a controller 355 is, but in other embodiments the controller 355 is distinct from, but operably coupled to, the computing device 352. Generally, the computing device 352 is also operably coupled to or includes a graphical user interface ("GUI") 365. The GUI 365 includes an input mechanism 370 for user-inputs or stimulation parameters. Such input mechanism 370 may support data input from local and/or remote locations. The GUI 365 may also include a display 375 for visually presenting information to the user in textual, graphic, or video form. A completion module 380 may be stored in the controller 355. The completion module 380 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The completion module 380 generally implements the task of completing a well with a stimulation pumping treatment.

The computing device 352 is also in communication with, or communicatively coupled to, a plurality of sensors 382. In one or more embodiments, the plurality of sensors 382 are associated with the completion unit 300, which includes the wireline unit 350, and provide feedback on the completion operation to the completion module 380 and/or the controller 355. The controller 355 and/or the completion module 380 is configured to receive the feedback or other data from the plurality of sensors 382 and to adjust the workflow or recipe to maintain optimal execution of the completion operation. In one or more embodiments, the plurality of sensors 382 may provide feedback or data on fluid and gas pressures within the wellbore in which completion operations are being performed. In one or more embodiments the plurality of sensors 382 monitor conditions including: line speed, line depth, line tension, a pump rate, and fluid-flow rate, and the like. The plurality of sensors 382 may also be monitoring for leaks and seismic activity. In one or more embodiments, the plurality of sensors 382 may provide feedback or data on a variety of conditions relating to the stimulation operation, including fluid and gas pressures within the wellbore, the completion unit 300, and the associated equipment, including the first pump system 60, which is pumping proppant rather than mud during the stimulation operation. The controller 355 is also configured to: receive a plurality of inputs 385 from a user via the input mechanism 370; and/or look up a plurality of inputs from a database. In some embodiments, the plurality of inputs 285 includes best practices input, operating parameters, and equipment identification input, etc.

The controller 355 is also in communication with, or communicatively coupled to, the completion unit 300. Moreover, and in some embodiments, the computing device 352 and/or the completion module 380 receive or at least access the drilling, pumping and logging data 235 related to the well that the completion unit 300 is stimulating or wells nearby to the well that the completion unit 300 is stimulating.

Figure 5:
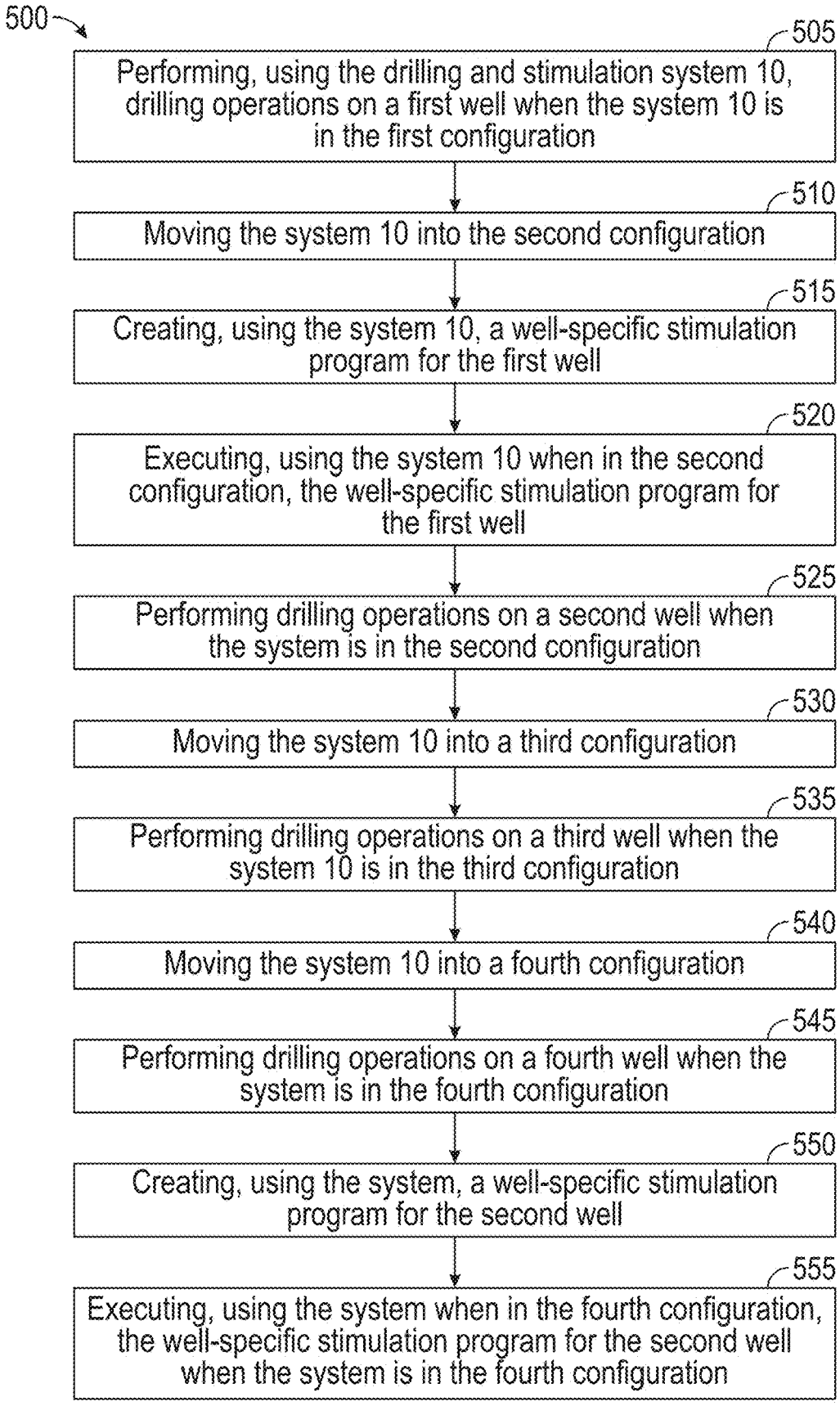
FIG. 5 is a flow-chart diagram of a method of using the system of FIGS. 1 and 3, according to one or more aspects of the present disclosure.

In an example embodiment, as illustrated in FIG. 5 with continuing reference to FIGS. 1-4, a method 500 of operating the system 10 includes performing, using the drilling and completion system 10, drilling operations on a first well when the system 10 is in the first configuration at step 505; moving the system 10 into the second configuration at step 510; creating, using the system 10, a well-specific stimulation program to the first well at step 515; executing, using the system 10 when in the second configuration, the well-specific stimulation program for the first well at step 520; performing drilling operations on a second well when the system 10 is in the second configuration at step 525; moving the system 10 into a third configuration at step 530; performing drilling operations on a third well when the system 10 is in the third configuration at step 535; moving the system 10 from the third configuration to the fourth configuration at step 540; performing drilling operations on a fourth well when the system 10 is in the fourth configuration at step 545; creating, using the system 10, a well-specific stimulation program for the second well at step 550; executing, using the system 10 when in the fourth configuration, the well-specific stimulation program for the second well at step 545.

In some embodiments, the step 505 comprises performing, using the drilling and completion system 10, drilling operations on a first well when the system 10 is in the first configuration. In some embodiments, the first well is one of the wells 70*a*, 70*b*, 70*c*, and 70*d*. In some embodiments, the pump system 60 is operably coupled to the drilling apparatus 55 and the pump system 135 is positioned near the second well pad 132 when the drilling apparatus 55 performs drilling operations on the first well. In some embodiments, the apparatus 55, including the controller 190, gathers drilling and logging data 235 associated with the first well during the step 505.

In some embodiments, the step 510 comprises moving the system 10 into the second configuration at step 510. In some embodiments, the step 510 comprises moving the drilling apparatus 55 and the shakers 100 to the second well pad 132 such that the apparatus 55 is capable of being connected to the second pump system 135. In some embodiments, the step 510 also includes positioning the completion unit 300 near or on the first well pad 50 such that the completion unit 300 is connected to include the first pump system 60.

Figure 6:
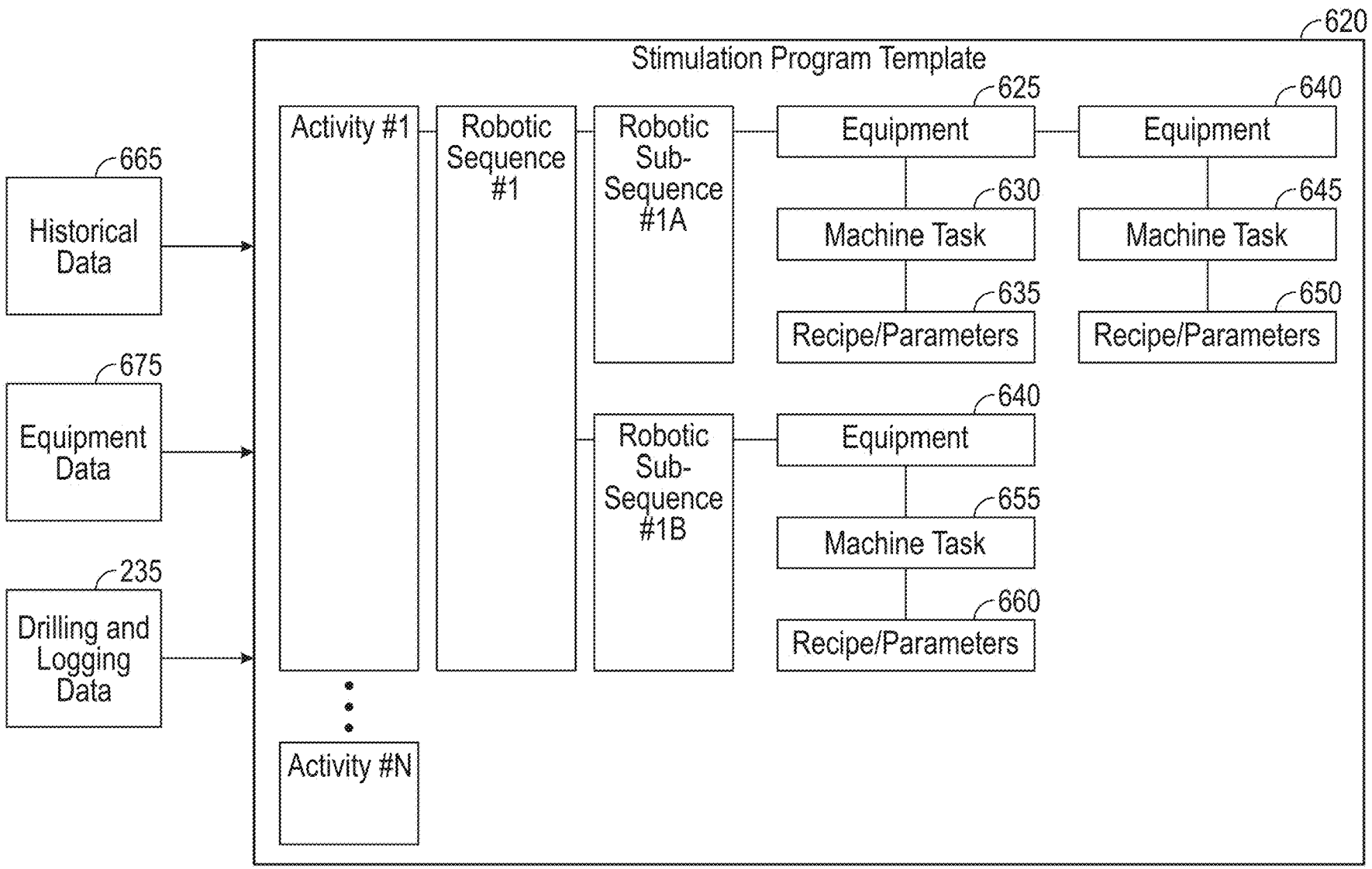
FIG. 6 is a diagrammatic illustration of a data flow used during the method of FIG. 5, according to one or more aspects of the present disclosure.

In some embodiments, the step 515 comprises creating, using the system 10, a well-specific stimulation program to the first well. The completion module 380 is configured to create a stimulation program for a well using a stimulation program template 620 (illustrated in FIG. 6). FIG. 6 is an example diagrammatic illustration of a data flow used by the completion module 380 that involves the stimulation program template 620 to create the well-specific stimulation program for the first well. The template 620, as illustrated, includes a plurality of activities from activity #1 to activity #n, with the plurality of activities being the activities required to execute a well-specific stimulation program. In some embodiments, the stimulation program is a low-rate stimulation program. In some embodiments, one or more robotic sequences is associated with each activity. As illustrated, robotic sequence #1 is associated with activity #1. One or more robotic sub-sequences can be associated with a robotic sequence. As illustrated, robotic subsequence #1a and robotic subsequence #1b is associated with the robotic sequence #1. In some embodiments, each robotic subsequence is associated with equipment, a machine task associated with the equipment, and recipe/parameters associated with the equipment. As illustrated, robotic sub-sequence #1a is associated with equipment 625 and its associated machine task 630 and recipe/parameters 635 and is associated with equipment 640 and its associated machine task 645 and recipe/parameters 650. Further, robotic subsequence #1b is associated with equipment 640 and its associated machine task 655 and recipe/parameters 660. In some embodiments, the same equipment is used in more than one robotic sub-sequence but the machine task associated with the equipment may differ between robotic subsequences. In other embodiments, the same equipment is used in more than one robotic sub-sequences for the same machine task but the recipe/parameters differ between machine tasks. Further and in other embodiments, the same equipment is used in more than one robotic sub-sequences for the same machine task using the same recipe/parameters. Each of the robotic sub-sequences includes one or more machine tasks performed by the equipment based on the recipe/parameters. The recipe/parameters may include computer-implemented instructions for executing the repeatable robotic sub-sequences from beginning to end. In some embodiments, the stimulation program template 620 includes a library of activities, robotic sequences, robotic sub-sequences, and equipment, machine task, recipe/parameters combinations. In other embodiments, the stimulation program template 620 includes a default stimulation program that includes a pre-set combination of activities, robotic sequences, and robotic sub-sequences that can be modified to create a well-specific stimulation program. In some embodiments, a robotic sub-sequence is associated with a predetermined workflow or recipe that executes the machine task using the equipment from beginning to end. Often, the predetermined workflow includes a set of computer-implemented instructions for executing the task from beginning to end, with the task being one that includes a repeatable sequence of steps that take place to implement the task. In some embodiments, when well-specific stimulation program is created using the stimulation program template 620, historical data 665 is considered, equipment data 675 is considered, and the drilling and logging data 235 is considered.

In one or more embodiments, the historical data 665 may include historical data associated with past completion activities, including the planned activities and results from executing the planned activities, for offset wells; past completion activities, including the planned activities and the results from executing the planned activities, for activities using specific types of equipment, specific machine tasks, and associated specific parameters/recipes; past completion activities, including the planned activities and results from executing the planned activities, for wells in a specific basin or formation; past completion activities, including the planned activities and results from executing the planned activities, for robotic sequences or robotic sub-sequences, and the like.

In one or more embodiments, the equipment data 675 includes a listing of equipment that is associated with the drilling and completion system 10. In some embodiments, the equipment data 675 includes a listing of equipment that forms a portion of the drilling and completion system 10 and/or a listing of equipment that is available to form a portion of the drilling and completion system 10.

In one or more embodiments, the drilling and logging data 235 includes, for example, data associated with the well for which the stimulation program is being created. In some embodiments, the drilling and logging data 235 is the data collected via the drilling apparatus 55 during drilling operations of the well. In some embodiments, the drilling and logging data 235 includes leak off test data, drilling mechanical specific energy ("MSE") data, and ultrasonic imaging data.

In some embodiments and as noted above, when well-specific stimulation program is created using the stimulation program template 620, historical data 665 is considered, equipment data 675 is considered, and the drilling and logging data 235 is considered. For example, the historical data 665, the equipment data 675, and the drilling and logging data 235 is used to customize the well-specific stimulation program. For example, the drilling and logging data 235 may be used to tune the low rate stimulation program. Specifically, leak off test data includes information may be used to design of the fracture treatment, or select the appropriate combination of activities and robotic sequences and/or set the recipe/parameters used in a robotic sub sequence. In another embodiment, the drilling and logging data 235 includes foot by foot ultrasonic imaging of the formation through which the well extends and this ultrasonic imaging may be used to indicate existing fractures and whole volume, shape, cement calculations. Similarly to the leak off test data, the ultrasonic imaging may be used to select a combination of activities and robotic sub sequences and/or set the recipe/parameters used in a robotic sub sequence. With respect to using the equipment data 675 when creating the well-specific stimulation program, the robotic sub sequences may be selected based on the type of equipment available or that forms a portion of the system 10 and/or set recipe/parameters for the type of equipment. That is, the well-specific stimulation program is designed to use the equipment that forms the completion unit 300. With respect to using the historical data 665 when creating the well-specific stimulation program, in some embodiments the well-specific stimulation program is created based on the performance or results of previous stimulation programs. As such, the method of creating stimulation programs may be improved over time when the performance of past stimulation programs is considered. For example, if the equipment 625 was used to execute the machine task 630 using similar recipe/parameters to the recipe/parameters 635 in a nearby or offset well and the performance of that sub-sequence was unexpected and less than optimal, then based on this historical information, the recipe/parameters may be changed to prevent a similar performance. In addition to the historical data 665, the equipment data 675, and the drilling and logging data 235, additional instructions, rules, or user inputs are considered when creating the well-specific stimulation program. These instruction, rules, or user inputs may include specific parameters associated with a customer, etc.

In some embodiments, the completion module 380 creates the well-specific stimulation program and therefore receives or accesses the stimulation program template 620, the historical data 665, the equipment data 675, and the drilling and logging data 235. However, in other embodiments, a computing device distinct from the completion module 380 creates the well-specific stimulation program and therefore receives or accesses the stimulation program template 620, the historical data 665, the equipment data 675, and the drilling and logging data 235; and the completion module 380 accesses the well-specific stimulation program from the computing device and executes the well-specific stimulation program.

In some embodiments and as discussed above, a well-specific stimulation program may be based on one or more of the following: the well bore design, planned stimulation activities, a specific basin (e.g., the Permian basin), a particular customer, and a set of pre-stored data sets. In some embodiments, the recipe/parameters may be based on: (1) equipment inventory, (2) rig inventory, (3) type of rig, (4) offset cost, (5) a time cost, (6) basin, (7) machine tasks, (8) stimulation activities, (9) robotic sequence steps, or the like. In one embodiment, a well-specific stimulation program is based on a specific well, with the customized stimulation program being based on the type of equipment associated with the specific well, the stimulation activities planned for the specific well, a basin in which the specific well is located, customer requests, etc. In some embodiments, the completion module 380 uses various methods that may include artificial intelligence and machine learning ("AI/ML") or other statistical methodologies to create the well-specific stimulation program. In some embodiments, the well-specific stimulation program includes the robotic sequence steps that control one or more components of the drilling and completion system 10 such as the first pump system 60 and/or the second pump system 135. In various embodiments, the well-specific stimulation program includes robotic sequence steps that control duration and other parameters of one or more components of the drilling and completion system 10. In some embodiments, the well-specific stimulation program for the first well includes a plurality of target parameters for specific activities using specific equipment associated with the system 10.

In some embodiments, the step 520 comprises executing, using the system 10 when in the second configuration, the well-specific stimulation program for the first well. In some embodiments and at step 520, the well-specific stimulation program for the first well is executed by the controller 355. In one or more embodiments, the well-specific stimulation program for the first well is created by the completion module 380 and is accessible by the controller 355. In other embodiments, at step 520, the well-specific stimulation program for the first well is transmitted to, or accessed by, the controller 355 by another controller or module. The optimized computer readable instructions or recipes and the optimized sequences of the well-specific stimulation program for the first well are executed by the controller 355 and performed by the various equipment and machinery of the completion unit 300. During execution of the well-specific stimulation program for the first well, the completion module 380 collects real-time information from the plurality of sensors 382. This information is, or is used to calculate, real-time completion parameters, which is compared to the target parameters of the well-specific stimulation program for the first well. The comparison is then used to modify operation of the completion unit 300 in an effort to reduce any difference between the target parameters and real-time completion parameters. As such, a feedback control loop is formed, with the controller 355 adjusting operation of the completion unit 300 based on a comparison (e.g., difference) of the target parameters and the real-time completion parameters, and the plurality of sensors 382 monitoring the real-time completion parameters, to bring the real-time completion parameters closer to the target parameters.

One example activity in the well-specific stimulation program for the first well comprises a wireline pump down. Generally, in a wireline pump down, a plug and perforating guns are connected to an electric wireline, which is positioned in the wellbore and fluid is pumped from the surface to convey the plug and perforating guns to a desired depth, where the plug is set and guns are fired, creating tunnels through the casing and cement and into the formation. The perforations provide reservoir access for subsequent fracturing operations. Generally, after each fracturing treatment, a plug and perforating guns are lowered into the well and pumped down to isolate the completed stage and prepare the next stage for fracturing. This process is repeated until all stages in the well have been completed according to the well design. In some embodiments and when the activity is a wireline pump down for the first well, the guns are made up and armed, then the guns and plug are pulled into a lubricator on the first well. The lubricator is made up to the pressure head, the swab and master valves are opened, and the mud pumps, such as the first pump system 60 that forms a portion of the completion unit 300, pump fluid so that the guns and plug are pumped downhole.

In some embodiments and when the activity is a wireline pump down for the first well, the robotic sequence of the stimulation program may be a "wireline pump down" and the associated robotic sub-sequence is "wireline pump down preparation" and another associated robotic sub-sequence that is "wireline pump down." In some embodiments, the robotic sub-sequence for the wireline pump down preparation includes pressurizing the lubricator to wellbore pressure using the completion unit 300, which includes the first pump system 60, as the equipment that has a machine task to pressurize the lubricator, the plurality of sensors 382 to detect the pressure of the lubricator, and the completion module 380 to compare the target pressure, which is the target parameter listed in the well-specific stimulation program for the first well compared to the real-time pressure detected by the plurality of sensors 382. The robotic sub-sequence for the wireline pump down preparation may also include, after the completion of the sub-sequence for pressurizing the lubricator, opening the swab and master valves using equipment that includes valve actuators for the swab and master valves, the machine task being opening the swab and master valves, and the target parameters being an open status for the swab and master valves. In some embodiments, the robotic sub-sequence associated with the wireline pump down includes pumping the plug and perforating guns down the wellbore of the first well. The equipment associated with the sub-sequence may include the completion unit 300, which includes the first pump system 60; the machine task may be positioning the plug and perforating guns at the target position, and the parameters may include speed/tension of the wireline and/or the depth/location of the plug and perforating guns. In some embodiments and when creating the well-specific stimulation program for the first well, the completion module 380 accesses the well directional trajectory and/or rig pipe tally associated with the first well and therefore identifies curves in the well. As such and in some embodiments, the robotic sub-sequence for the wireline pump down may include recipe/parameters created in response to increased friction at certain depths that correspond to curves in the well. Additionally, and in some embodiments, the completion unit 300 uses the closed loop system so that the controller 355 monitors the line tension, wireline drum speed, and depth input signals from the wireline unit 350 and controls the first pump system 60 (and other pumps in the completion unit 300) to increase the pump rate proportionally to overcome friction, which may be indicated as a decrease in tension in line tension and/or a decrease in line speed, and maintain constant wireline descent speed in the first well. In some embodiments, the system 10 uses the first pump system 60 timed with the wireline drag force response to pump the guns past a curve to a "Stage 1" measured depth interval.

In some embodiments and when the activity is a leak off test, which is used to determine the fracture pressure of an open formation wireline pump down, the robotic sequence of the stimulation program may be a "leak off test" and the associated robotic sub-sequence is pressurizing the wellbore, another associated robotic sub-sequence may include holding the pressurized test in the wellbore, and yet another associated robotic sub-sequence may include when test pressure is reached, holding the test pressure, automatically shutting off pumps and recording the test pressure. The robotic sub-sequence of pressurizing the wellbore may include the completion unit 300, including the first pump system 60, as the equipment; the machine task of activating the first pump system 60, and the activation of the first pump system 60 may be based on target parameters/recipe, such as for example a target test pressure. Other sub-sequences may be executed dependent upon the performance or result of a previous sub-sequence. For example, if the test pressure does not hold or test pressure is not reached, then a sub-sequence that shuts the pumps down may be executed.

In some embodiments, the step 525 comprises performing drilling operations on a second well when the system 10 is in the second configuration. In some embodiments, the second well is one of the wells 70*e*, 70*f*, 70*g*, and 70*h*. In some embodiments, the step 525 occurs simultaneously with the step 520. For example, the system 10 performs drilling operations on one of the wells 70*c*-70*h* using the second pump system 135 while the system 10 also performs completion operations on one of the wells 70*a*-70*d* using the first pump system 60. In some embodiments, the apparatus 55, including the controller 190, gathers drilling and logging data 235 associated with the second well during the step 525.

Figure 7:
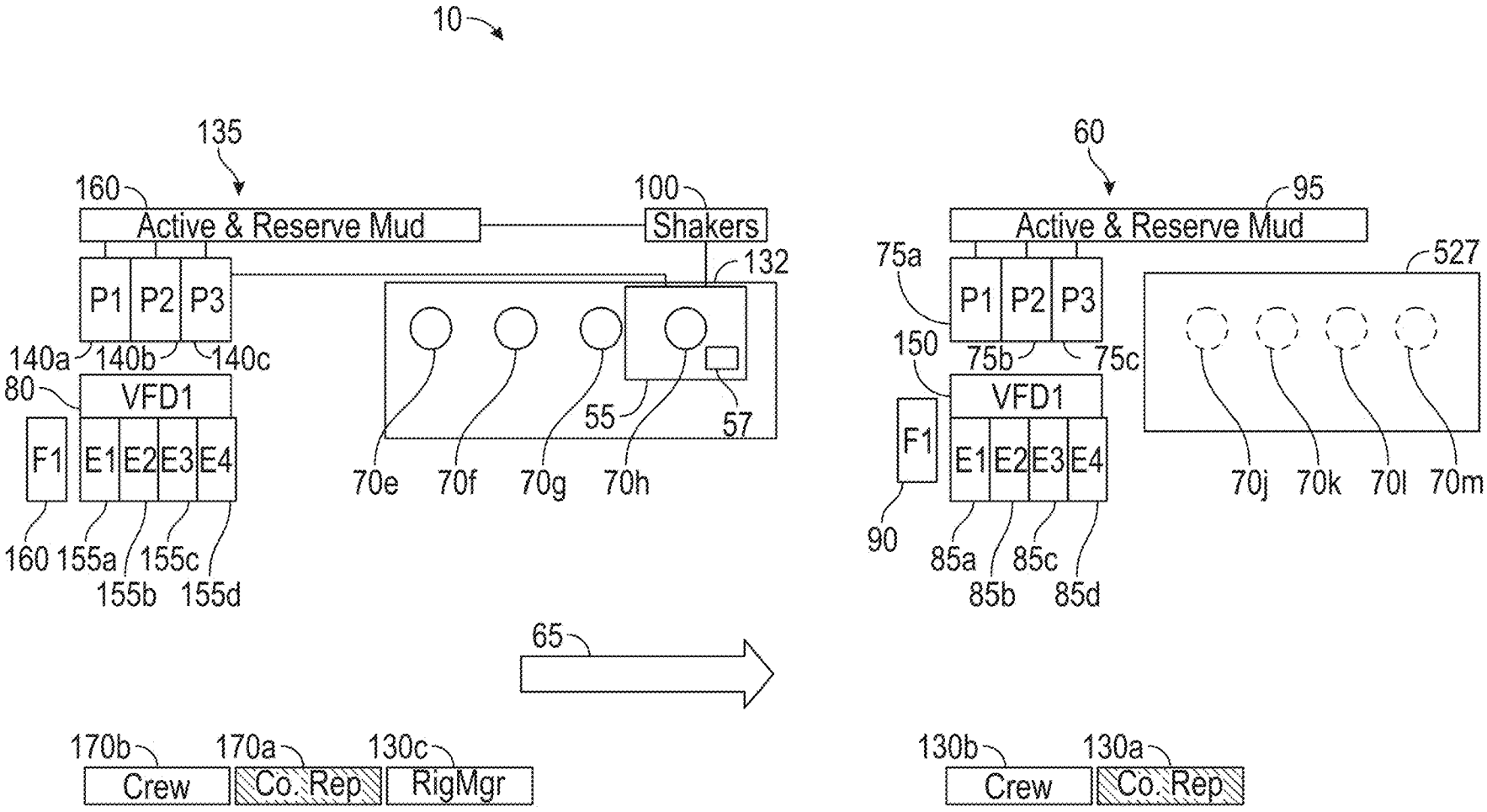
FIG. 7 is a schematic diagram of the well pads of FIG. 3 upon which the drilling and completion system is in a third configuration, according to one or more aspects of the present disclosure.

In some embodiments, the step 530 comprises moving the system 10 into a third configuration. FIG. 7 is a schematic top view of a portion of a drilling and completion system 10 in a third configuration. In the third configuration, and as illustrated, the drilling apparatus 55 and shaker 100 are located near or proximate to the second well pad 132 such that the shaker 100 is operably coupled to the mud system 130 and the drilling apparatus 55 is performing drilling operations on one of the wells 70*e*-70*h* (illustrated with drilling apparatus 55 performing drilling operations on well 70*h* in FIG. 6). Further, FIG. 7 illustrates a third well pad 527 that includes a series of wells 70*j*, 70*k*, 70*l*, and 70*m*. The first mud system 60 has been moved from the first well pad 50 and is now proximate to or on the third well pad 527 to support drilling operations of the wells 70*j*-70*m*. In some embodiments, the company man trailer 130*a* and crew quarters structures 130*b* have also been moved such that they are associated with the wells 70*j*-70*m*.

In some embodiments, the step 535 comprises performing drilling operations on a third well when the system 10 is in the third configuration. In some embodiments, the apparatus 55, including the controller 190, gathers drilling and logging data 235 associated with the third well during the step 525. While the drilling apparatus 55 is illustrated in FIG. 7 as positioned over the well 70*h* in the third configuration such that the well 70*h* is illustrated as the third well, the drilling and completion system 10 may also be the third configuration when the apparatus 55 is positioned over each of the wells 70*e*, 70*f*, and 70*g*, which are associated with the second well pad 132. As noted above and when in the third configuration, the second pump system 135 is operably connected to the drilling apparatus 55 such that the controller 190 controls the second pump system 135 while drilling operations are being performed on one of the wells 70*c*, 70*f*, 70*g*, and 70*h*. In some embodiments and when the drilling and completion system 10 is in the third configuration, the completion operations have finished for the wells in the first well pad 50 and the first pump system 60 is positioned near the wells 70*j*-70*m* and is waiting to be operably coupled to the drilling apparatus 55 when the system 10 is in a fourth configuration so that the drilling apparatus 55 is capable of performing drilling operations on the wells 70*j*-70*m*.

Figure 8:
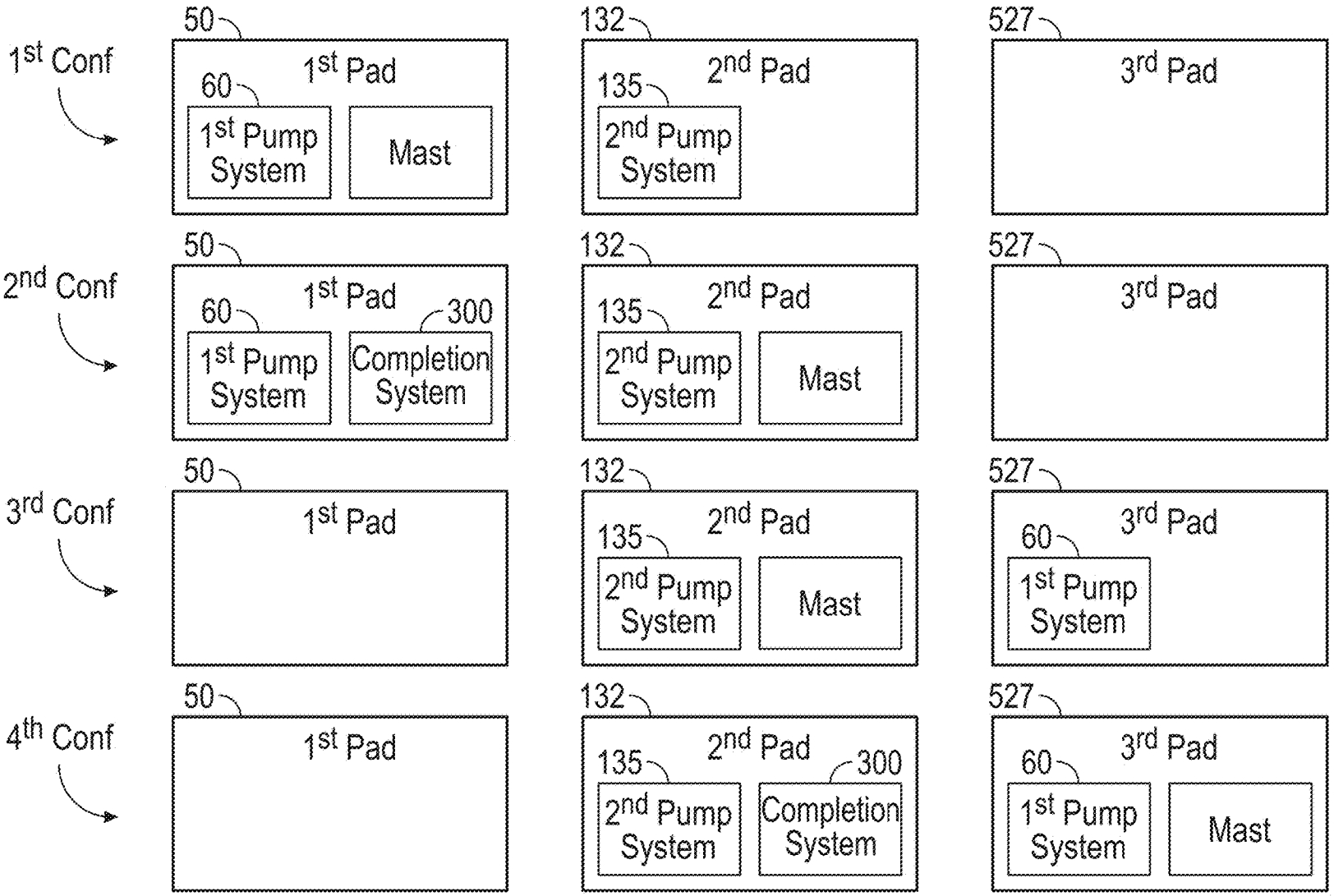
FIG. 8 is a schematic diagram illustrating the system of FIG. 1 in the first configuration, the second configuration, the third configuration, and a fourth configuration, according to one or more aspects of the present disclosure.

In some embodiments, the step 540 comprises moving the system from the third configuration to the fourth configuration. FIG. 8 illustrates the system in the first configuration, second configuration, third configuration, and the fourth configuration with respect to the well pads 50, 132, and 527. In the fourth configuration, the drilling apparatus 55, which is listed as "mast" in FIG. 8, is positioned near or on the third well pad 527 and drilling operations are capable of occurring on one of the wells 70*j*-70*m* while the completion unit 300 is positioned on the second well pad 132.

In some embodiments, the step 545 comprises performing drilling operations on a fourth well when the system 10 is in the fourth configuration. In some embodiments, the fourth well is one of the wells 70*j*-70*m*.

In some embodiments, the step 550 comprises creating, using the system 10, a well-specific stimulation program for the second well. The step 540 is substantially similar to the step 515 except that the stimulation program is created for the second well instead of the first well. As such, further details will not be repeated here. In some embodiments, the step 550 occurs simultaneously with any one or more of the steps 530, 535, 540, and 545.

In some embodiments, the step 555 comprises executing, using the system 10 when in the fourth configuration, the well-specific stimulation program for the second well when the system 10 is in the fourth configuration. The step 555 is substantially similar to the step 520 except that the stimulation program for the second well is executed on the second well instead of the stimulation program for the first well being executed on the first well. As such, further details will not be repeated here.

Moving the system 10 from the first configuration to the second configuration and then to the third configuration and the fourth configuration allows for portions of the system 10 (e.g., one of the pump systems) to leapfrog, sequentially and between pads, over other portions of the system 10 (e.g., the other of the pump systems and/or the drilling apparatus) to improve the efficiency of drilling and completing wells while reducing the footprint compared to conventional stimulation systems. In some embodiments, the leapfrogging of portions of the system 10 requires that the portions of the system 10 to be used in both drilling operations and completion operations. In some embodiments, the leapfrogging of the first and second pump systems 60 and 135 continues repeatedly.

The system 10 and/or the method 500 may be altered in a variety of ways. For example and in some embodiments, the completion unit 300 is not limited to well stimulation operations and may complete other completion operations such as wireline operations, etc.

In some embodiments, and when the completion unit 300 is configured to automatically and robotically complete a wireline operation, the completion unit 300 uses the plurality of sensors 382 to detect line speed, line tension, depth, and pump speed, and based on the detected information, auto adjust and optimize the mud pumps and/or perforation equipment.

In one or more aspects, the completion unit 300 may receive real-time data from a source (e.g., the plurality of sensors 382) to determine deviations from the expected execution of the well-specific stimulation program for the well. In some embodiments, historical data, physics models, statistical models, and the like are inputs when creating the well-specific stimulation program for a well. In one or more embodiments, the completion module 380 may use the stored inputs (e.g., expected outputs) to compare to actual outputs to determine deviation. In some embodiments, the completion module 380 may pause or stop the robotic sequence if the deviation value (e.g., expected output versus actual output) exceeds a threshold value or range. In other embodiments, the completion module 380 alters the robotic sequence in real-time based on the deviation value. That is, and in some embodiments, the completion module 380 alters the well-specific stimulation for the well while executing a portion of the well-specific stimulation for the well.

In one or more embodiments, data used by the completion module 380 may be stored in a database that is remote from the completion module 380 and the completion module 380 accesses the stored data via a network. In an example embodiment, the network includes the Internet, one or more local area networks, one or more wide area networks, one or more cellular networks, one or more wireless networks, one or more voice networks, one or more data networks, one or more communication systems, and/or any combination thereof. In some embodiments, the network also includes WIFI, Bluetooth, and Long-Term Evolution ("LTE") or other wireless broadband communication technology. In some embodiments, the creation of the well-specific stimulation program for the well occurs at a location remote from the well pad 50 and/or the system 10 and is provided to the completion module 380 via a network. In some embodiments, a portion of the completion module 380 is stored on a computing device that forms a portion of the system 10 but is remote from the well pad 50 and another portion of the completion module 380 is stored on the computing device 352 that is on-site at the well pad 50.

In some embodiments, the completion unit 300 is different from the drilling apparatus 55 in that the drilling apparatus 55 is configured to drill the wellbore to the target zone whereas the completion unit 300 is configured for completion operations on the drilled well. As disclosed herein, completion operations include wireline operations, fracturing operations, etc. In some embodiments, at least a portion of the completion unit 300 is, includes, or is a part of a drilling apparatus 55 that has been retrofitted or configured to be a stimulation system. For example and as illustrated in FIGS. 1, 3A, 3B, and 6 the first pump system 60 is configured to form a part of the drilling apparatus 55 when operably coupled to the drilling apparatus 55 but also form a part of the completion unit 300 when operably coupled to completion unit 300. As such, each of the first pump system 60 and the second pump system 135 is a dual-use pumping system because each is configured to switch between pumping in drilling operations and pumping in completion operations.

In some embodiments, the first pump system 60, the second pump system 135, and the drilling apparatus 55 may be altered in a variety of ways compared to a conventional pump system and drilling apparatus 55. For example, the alterations may include modified rig moves, clearance for simops or simultaneous operations and offline manifolds; use of various slurry weights, proppant mesh, acid %, flushing procedures; modified crew workflows; reduced footprint; use modified rig tanks for dedicated slurries, actuated lineups; modified or new human machine interface "HMI" screens for cement, proppant, acid, heavy mud stimulation; modified pre and post fracture qty, orientation, location along the trajectory; modified time lapse production logs mapped on original post frac image; and modified or new hole and cement volume HMI schematics and calculations.

At least portions of the completion unit 300, such as the first pump system 60 and the second pump system 135, can be configured for both drilling operations and stimulation operations, in one or more embodiments, because of the utilization of a low-rate stimulation program.

As a result of implementing the low-rate stimulation program and being able to perform both drilling operations and stimulation operations using the system 10, a number of benefits and cost savings are realized. Because the drilling apparatus 55 and the completion unit 300 share the first and second pump systems 60 and 135, the setup and tear-down times (or "rig-up" and "rig-down" times) of the system 10 is substantially reduced, enabling more wells to be drilled per year with the same rig. Significant cost savings in man-hours are also realized because less time is spent changing out equipment and fewer workers are need on site. Being able to use the first and second pump systems 60 and 135 in drilling and completion operations results in less driving time as stimulation-specific equipment no longer needs to be trucked to the well pads 50, 132, and 527. Less driving time translates to less fuel costs and man-hour costs, and also reduces the carbon footprint of the drilling and completion operation. Reduced driving time and rig-up and rig-down times also improve worker safety because less man-hours and driving time will ultimately reduce the incidence of injuries and accidents.

Furthermore, the use of the low-rate stimulation program with the pump systems 60 and 135 and other equipment for stimulation operations allows for automation of significantly more of the drilling and completion operations and facilitates fewer and shorter gaps in the automated processes that would typically be required to enable workers to change out and setup new equipment, for example.

Implementation of a low-rate stimulation program with the completion unit 300 enables the pumps 75*a*-75*c* of the first pump system 60 and the pumps 140*a*-140*c* of the second pump system 135 to switch between pumping mud during drilling operations and then pump proppant into the cracks in the rock formation during completion operations. To facilitate use of the pumps 75*a*-75*c* and 140*a*-140*c* and the low-rate stimulation program, the proppant used with the completion system 300 is in the finer (or higher mesh) range of proppant typically available for stimulation operations. In one or more embodiments, for example, proppant in the range of 100-325 mesh is used by the completion unit 300 and pumped by the pumps 75*a*-75*c* and 140*a*-140*c*.

The systems and methods disclosed herein provide improvements to the methods and systems used during conventional hydraulic well stimulation. For example, in some embodiments, the system 10 provides an optimized end-to-end robotic sequence that is capable of stimulating the reservoir using a low-rate stimulation program and that is also uses mud pump systems that are also used in drilling operations.

In some embodiments, the system 10 and/or the method 500 provide a number of advantages over conventional systems. In some embodiments, the system 10 and/or method 500 provide (1) mechanical improvements, (2) environmental improvements, (3) logistical improvements, (4) safety improvements, and (5) cost improvements. For instance, a cost improvement provided by the system 10 and/or the method 500 is a lower well completion cost due to elimination of the hydraulic horsepower ("HHP") requirement and elimination of use of conventional surface pumping equipment for stimulations. Additionally, cost may be reduced due to fewer man-hours spent driving and on location due to the improved workflows of the system 10 and/or the method 500. The reduction of people on-site and driving also increases safety for the workers, which is an example safety improvement. Cost may be further reduced by having a lower mobilization and demobilization cost per well by eliminating conventional well stimulation pumps, which is a further cost improvement example. Another example advantage is a reduction in greenhouse gas emissions ("GHG") due to lower fuel consumption, which is a mechanical and environmental improvement. Yet another example advantage is lowering chemical consumption and disposal due to a smaller proppant diameter. In yet another example improvement, the lower rates programmed by the system 10 may enable less expensive and widely available "buttress" casing connections to be used in place of "premium" connections for high pressure/high-rate applications. In some embodiments, the system 10 and/or the method 500 describe pumping, using mud pumps of a drilling rig, at a low rate to displace particle proppant in the formation. Additional advantages include lowering seismicity due to decreased pressure and pumping rates; providing alternative location options including locations with limited conventional well stimulation fleet supply; directing propagation using automated stimulation of stacked pay zones with optimized rates/density; lowering pump repair and maintenance cost with high mesh proppant, lower rates, and lower pressures; and identifying existing natural fractures during drilling processes to use for stimulation processes.

In some embodiments, the term "frac" used herein is interchangeable with the term "well stimulation" or "stimulation." In some embodiments, the formation and use of a closed loop system in the system 10 results in a robotic system that is capable of executing completion operations.

Figure 9:
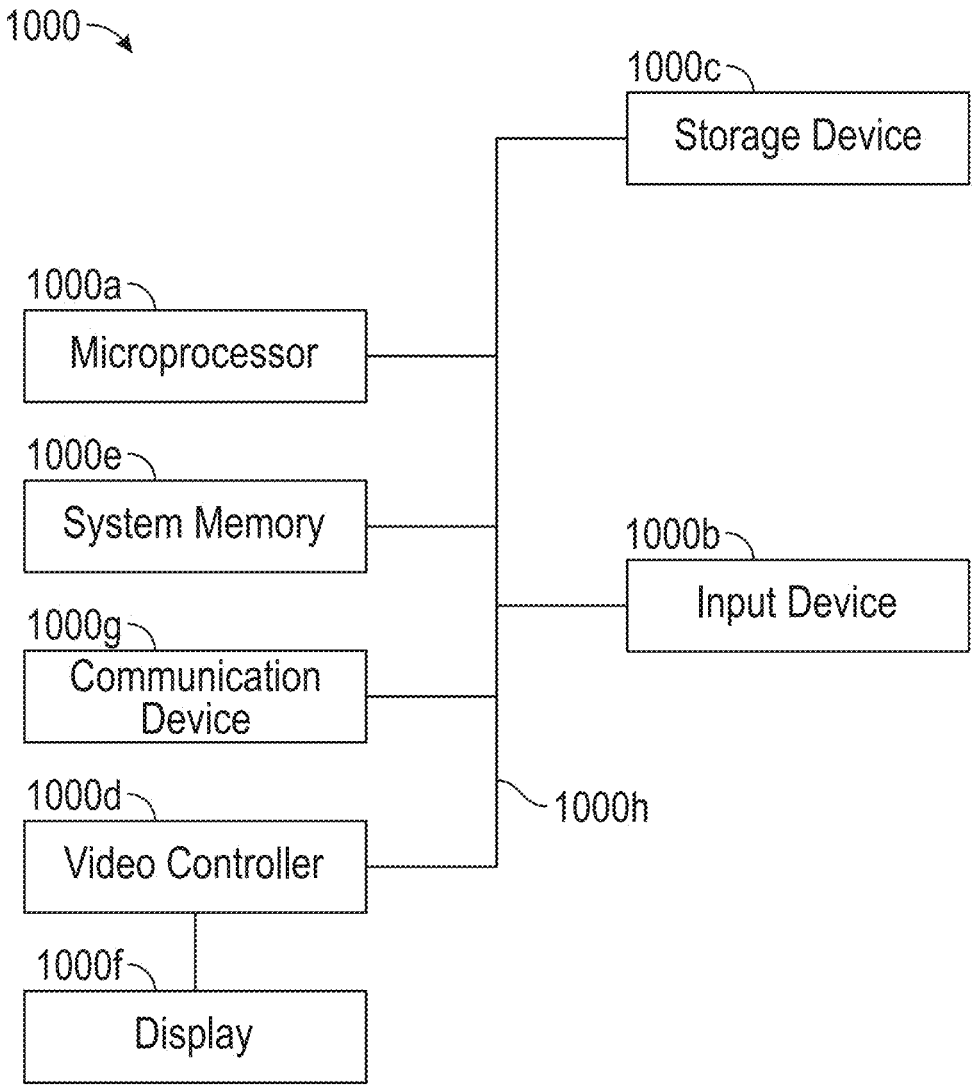
FIG. 9 is a diagrammatic illustration of a node for implementing one or more example embodiments of the present disclosure, according to one or more aspects of the present disclosure.

FIG. 9, with continuing reference to FIGS. 1-8, provides an illustrative node 1000 for implementing one or more of the example embodiments described above and/or illustrated in FIGS. 1-8 is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1-8 include at least the node 1000 and/or components thereof, and/or one or more nodes that are substantially similar to the node 1000 and/or components thereof. In several example embodiments, one or more of the above-described components of the node 1000, the system 10, and/or the example embodiments described above and/or illustrated in FIGS. 1-8 include respective pluralities of same components.

In several example embodiments, one or more of the applications, systems, and application programs described above and/or illustrated in FIGS. 1-8 include a computer program that includes a plurality of instructions, data, and/or any combination thereof; an application written in, for example, Arena, HyperText Markup Language (HTML), Cascading Style Sheets (CSS), JavaScript, Extensible Markup Language (XML), asynchronous Javascript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof. The one or more server(s), in some embodiments may be remote (e.g., remote from system 10) and accessible by a cloud or other network described herein. In other embodiments, the one or more server(s) are described as one or more edge server(s) and are located on or in the system 10.

In several example embodiments, a computer system or computing device typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server. In some embodiments, software includes one or more software modules (such as well stimulation module and the low-rate stimulation module of FIGS. 8 and 9) including code, programming object, programming structure, or combinations thereof. In one or more embodiments, the one or more software modules comprise, by way of nonlimiting examples, a web application, a mobile application, and a standalone application. In various embodiments, software modules are in more than one computer program or application. In some embodiments, the software modules are hosted by more than one machine. In some embodiments, the software modules are hosted by more than one machine in more than one location.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random-access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A, B, or C; A and B, B and C, or A and C; or all three of A, B, and C."

The present disclosure introduces a method of performing completion operations and drilling operations on well pad (s), the method comprising: positioning a drilling and completion system in a first configuration on a first well pad and a second well pad; wherein the drilling and completion system comprises a first pump system and a drilling apparatus located on the first well pad and a second pump system located on the second well pad; wherein, when in the first configuration, the drilling apparatus is operably coupled to the first pump system at the first well pad; performing a first drilling operation, using the first pump system and the drilling apparatus, on a first well on the first well pad; moving the drilling and completion system from the first configuration to a second configuration on the first well pad and the second well pad; wherein, when in the second configuration, the drilling apparatus is operably coupled to the second pump system at the second well pad; wherein the drilling and completion system further comprises a completion unit; wherein, when in the second configuration, the completion unit is operably coupled to the first pump system on the first well pad; performing a second drilling operation, using the second pump system and the drilling apparatus when the drilling and completion system is in the second configuration, on a second well on the second well pad; and performing a first completion operation, using the first pump system and the completion unit when the drilling and completion system is in the second configuration, on the first well on the first well pad. In some embodiments, performing the second drilling operation, using the second pump system and the drilling apparatus, on the second well pad and performing the first completion operation, using the first pump system and the completion unit, on the first well pad occurs simultaneously. In some embodiments, the method also includes saving, by the drilling and completion system, drilling data generated during the first drilling operation on the first well; and creating, by the drilling and completion system, a first well completion program using the drilling data generated during the first drilling operation; wherein performing the first completion operation, using the first pump system and the completion unit, on the first well comprises the drilling and completion system executing the first well completion program. In some embodiments, the completion unit further comprises: a sensor monitoring a completion parameter associated with the first completion operation; a completion unit controller capable of controlling the operation of the first pump system when the drilling and completion system is in the second configuration; wherein the first well completion program comprises a target parameter; and wherein the completion unit controller, when the drilling and completion system is in the second configuration and when the first pump system and the completion unit are performing the first completion operation, is capable of: receiving the completion parameters from the sensor; determining a difference between the completion parameter and the target parameters; and generating control signals, based on the difference, for the first pump system to reduce the difference such that the completion unit controller, the sensor, and the first pump system form a closed loop system when in the drilling and completion system is in the second configuration. In some embodiments, wherein the completion unit controller further comprises a robotic sequence controller capable of executing predefined robotic sequences for automated tasks during the first completion operation; wherein the robotic sequence controller, based on the completion parameters and the target parameters, adjusts the robotic sequences to enhance the precision and efficiency of the first completion operation; and wherein the automated tasks of the robotic sequences are performed in coordination with the first pump system and the completion unit to improve performance of the first well completion program. In some embodiments, creating, by the drilling and completion system, a digital twin of the first well, wherein the digital twin is a virtual representation that integrates real-time data from the first well; using the digital twin to simulate and optimize the first well completion program prior to execution, thereby enhancing accuracy and efficiency in the completion operation. In some embodiments, the first completion operation comprise a wireline pump down. In some embodiments, the completion unit comprises a wireline unit; wherein the sensor is a plurality of sensors; wherein the plurality of sensors monitor one or more of line speed of the wireline unit, depth, or line tension such that the completion parameters comprise one or more of: line speed of the wireline unit, depth, or line tension; wherein the target parameter is one of a plurality of target parameters; and wherein the plurality of target parameters comprise one or more of a target line speed of the wireline unit, a target depth, or a target line tension. In some embodiments, drilling data generated during the first drilling operation on the first well comprises a curve in a wellbore associated with specific wellbore depth; and wherein the first well completion program comprises target parameters based on the curve in the wellbore associated with the specific wellbore depth. In some embodiments, the first completion operation comprise a leak off test. In some embodiments, the sensor monitors a wellbore pressure; and wherein target parameter comprises a target test pressure. In some embodiments, the method also includes moving the drilling and completion system from the second configuration to a third configuration on the second well pad and a third well pad; and wherein, when in the third configuration, the drilling apparatus is operably coupled to the second pump system at the second well pad; wherein, when in the third configuration, the first pump system is located at the third well pad; performing a third drilling operation, using the second pump system and the drilling apparatus, on a third well on the second well pad; moving the drilling and completion system from the third configuration to a fourth configuration on the second well pad and the third well pad; and wherein, when in the fourth configuration, the drilling apparatus is operably coupled to the first pump system at the third well pad; wherein, when in the fourth configuration, the completion unit is operably coupled to the second pump system at the second well pad; and performing a fourth drilling operation, using the first pump system and the drilling apparatus, on a fourth well on the third well pad while simultaneously performing a second completion operation, using the second pump system and the completion unit, on the third well at the second well pad.

The present disclosure also introduces a drilling and completion system for performing completion operations and drilling operations on well pads, wherein the drilling and completion system is capable of being positioned in a first configuration and a second configuration, wherein the system comprises: a first pump system, a second pump system, a drilling apparatus, and a completion unit; wherein, when in the first configuration, the first pump system and the drilling apparatus are located on the first well pad and the second pump system is located on the second well pad; wherein, when in the first configuration, the first pump system and the drilling apparatus are capable of performing a first drilling operation on a first well on the first well pad; wherein, when in the second configuration, the drilling apparatus is operably coupled to the second pump system at the second well pad and the completion unit is operably coupled to the first pump system; wherein, when in the second configuration, the second pump system and the drilling apparatus are capable of performing a second drilling operation on a second well on the second well pad; and wherein, when in the second configuration, the first pump system and the completion unit are capable of performing a first completion operation on the first well on the first well pad. In some embodiments, wherein, when in the second configuration, the second pump system and the drilling apparatus perform the second drilling operation on the second well on the second well pad and the first pump system and the completion unit perform the first completion operation on the first well on the first well pad simultaneously. In some embodiments, the drilling apparatus comprises a drilling apparatus controller; wherein the drilling apparatus controller is configured to save drilling data generated during the first drilling operation on the first well; wherein the completion unit comprise a completion controller; and wherein the completion controller is configured to create a first well completion program using the drilling data generated during the first drilling operation on the first well; wherein the completion controller is configured to execute first well completion program. In some embodiments, the completion unit further comprises a sensor monitoring a completion parameter associated with the first completion operation; wherein the completion controller is capable of controlling the operation of the first pump system when the drilling and completion system is in the second configuration; wherein the first well completion program comprises a target parameter; and wherein the completion unit controller, when the drilling and completion system is in the second configuration and when the first pump system and the completion unit are performing the first completion operation, is capable of: receiving the completion parameters from the sensor; determining a difference between the completion parameter and the target parameters; and generating control signals, based on the difference, for the first pump system to reduce the difference such that the completion unit controller, the sensor, and the first pump system form a closed loop system when in the drilling and completion system is in the second configuration. In some embodiments, the first completion operation comprise a wireline pump down; wherein the completion unit comprises a wireline unit; wherein the sensor is a plurality of sensors; wherein the plurality of sensors monitor one or more of line speed of the wireline unit, depth, or line tension such that the completion parameters comprise one or more of: line speed of the wireline unit, depth, or line tension; wherein the target parameter is one of a plurality of target parameters; and wherein the plurality of target parameters comprise one or more of a target line speed of the wireline unit, a target depth, or a target line tension. In some embodiments, drilling data generated during the first drilling operation on the first well comprises a curve in a wellbore associated with specific wellbore depth; and wherein the first well completion program comprises target parameters based on the curve in the wellbore associated with the specific wellbore depth. In some embodiments, the first completion operation comprise a leak off test. In some embodiments, the sensor monitors a wellbore pressure; and wherein target parameter comprises a target test pressure. In some embodiments, the method also includes wherein the drilling and completion is capable of being positioned in a third configuration and a fourth configuration on the second well pad and a third well pad; wherein, when in the third configuration, the drilling apparatus is operably coupled to the second pump system at the second well pad; and wherein, when in the third configuration, the second pump system and the drilling apparatus is capable of performing a third drilling operation on a third well on the second well pad; wherein, when in the fourth configuration, the drilling apparatus is operably coupled to the first pump system at the third well pad; wherein, when in the fourth configuration, the completion unit is operably coupled to the second pump system at the second well pad; and wherein, when in the fourth configuration, the first pump system and the drilling apparatus perform a fourth drilling operation on a fourth well on the third well pad while simultaneously the second pump system and the completion unit perform a second completion operation on the third well at the second well pad. In some embodiments, use of the first pump system and the second pump system in completion operations and drilling operations reduces or eliminates delivery, to a well site associated with one of the first, second, or third well pads, of high-volume well stimulation pumps via heavy trucks and thereby reduces greenhouse gas emissions.

One or more of the example embodiments disclosed above and in one or more of FIGS. 1-8 may be combined in whole or in part with any one or more of the other example embodiments described above and in one or more of FIGS. 1-8.

Although several example embodiments have been disclosed in detail above and in one or more of FIGS. 1-8, the embodiments disclosed are example only and are not limiting, and those skilled in the art will readily appreciate that many other modifications, changes, and substitutions are possible in the example embodiments without materially departing from the novel teachings and advantages of the present disclosure. Accordingly, all such modifications, changes, and substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112 (f) for any limitations of any of the claims herein, except for those in which the claim expressly uses the word "means" together with an associated function.

What is claimed is:

1. A method of performing completion operations and drilling operations on well pads, the method comprising:

positioning a drilling and completion system in a first configuration on a first well pad of the well pads and a second well pad of the well pads that is different from the first well pad;

wherein the drilling and completion system comprises a first pump system and a drilling apparatus located on the first well pad and a second pump system located on the second well pad;

wherein, when in the first configuration, the drilling apparatus is operably coupled to the first pump system at the first well pad;

performing a first drilling operation, using the first pump system and the drilling apparatus, on a first well on the first well pad;

moving the drilling and completion system from the first configuration to a second configuration on the first well pad and the second well pad;

wherein, when in the second configuration, the drilling apparatus is operably coupled to the second pump system at the second well pad;

wherein the drilling and completion system further comprises a completion unit;

wherein, when in the second configuration, the completion unit is operably coupled to the first pump system on the first well pad;

performing a second drilling operation, using the second pump system and the drilling apparatus when the drilling and completion system is in the second configuration, on a second well on the second well pad that is different from the first well pad; and performing a first completion operation, using the first pump system and the completion unit when the drilling and completion system is in the second configuration, on the first well on the first well pad.

2. The method of claim 1, wherein performing the second drilling operation, using the second pump system and the drilling apparatus, on the second well pad and performing the first completion operation, using the first pump system and the completion unit, on the first well pad occurs simultaneously.

3. The method of claim 1, further comprising:

saving, by the drilling and completion system, drilling data generated during the first drilling operation on the first well; and creating, by the drilling and completion system, a first well completion program using the drilling data generated during the first drilling operation;

wherein performing the first completion operation, using the first pump system and the completion unit, on the first well comprises the drilling and completion system executing the first well completion program.

4. The method of claim 3, further comprising:

creating, by the drilling and completion system, a digital twin of the first well;

wherein the digital twin is a virtual representation that integrates real-time data from the first well; and using the digital twin to simulate and optimize the first well completion program prior to execution, thereby enhancing accuracy and efficiency in the completion operation.

5. The method of claim 3, wherein the completion unit further comprises:

a sensor monitoring a completion parameter associated with the first completion operation;

a completion unit controller capable of controlling the operation of the first pump system when the drilling and completion system is in the second configuration;

wherein the first well completion program comprises a target parameter; and wherein the completion unit controller, when the drilling and completion system is in the second configuration and when the first pump system and the completion unit are performing the first completion operation, is capable of:

receiving the completion parameters from the sensor;

determining a difference between the completion parameter and the target parameters; and generating control signals, based on the difference, for the first pump system to reduce the difference such that the completion unit controller, the sensor, and the first pump system form a closed loop system when in the drilling and completion system is in the second configuration.

6. The method of claim 5, wherein the completion unit controller further comprises a robotic sequence controller capable of executing predefined robotic sequences for automated tasks during the first completion operation;

wherein the robotic sequence controller, based on the completion parameters and the target parameters, adjusts the robotic sequences to enhance precision and efficiency of the first completion operation; and wherein the automated tasks of the robotic sequences are performed in coordination with the first pump system and the completion unit to improve performance of the first well completion program.

7. The method of claim 5, wherein the first completion operation comprise a wireline pump down.

8. The method of claim 7, wherein the completion unit comprises a wireline unit;

wherein the sensor is a plurality of sensors;

wherein the plurality of sensors monitor one or more of line speed of the wireline unit, depth, or line tension such that the completion parameters comprise one or more of: line speed of the wireline unit, depth, or line tension;

wherein the target parameter is one of a plurality of target parameters; and wherein the plurality of target parameters comprise one or more of a target line speed of the wireline unit, a target depth, or a target line tension.

9. The method of claim 8, wherein drilling data generated during the first drilling operation on the first well comprises a curve in a wellbore associated with specific wellbore depth; and wherein the first well completion program comprises target parameters based on the curve in the wellbore associated with the specific wellbore depth.

10. The method of claim 5, wherein the first completion operation comprise a leak off test.

11. The method of claim 10, wherein the sensor monitors a wellbore pressure; and wherein target parameter comprises a target test pressure.

12. The method of claim 1, further comprising:

moving the drilling and completion system from the second configuration to a third configuration on the second well pad and a third well pad; and wherein, when in the third configuration, the drilling apparatus is operably coupled to the second pump system at the second well pad;

wherein, when in the third configuration, the first pump system is located at the third well pad;

performing a third drilling operation, using the second pump system and the drilling apparatus, on a third well on the second well pad;

moving the drilling and completion system from the third configuration to a fourth configuration on the second well pad and the third well pad; and wherein, when in the fourth configuration, the drilling apparatus is operably coupled to the first pump system at the third well pad;

wherein, when in the fourth configuration, the completion unit is operably coupled to the second pump system at the second well pad;

and performing a fourth drilling operation, using the first pump system and the drilling apparatus, on a fourth well on the third well pad while simultaneously performing a second completion operation, using the second pump system and the completion unit, on the third well at the second well pad.

13. A drilling and completion system for performing completion operations and drilling operations on well pads, wherein the drilling and completion system is capable of being positioned in a first configuration and a second configuration, wherein the system comprises:

a first pump system, a second pump system, a drilling apparatus, and a completion unit;

wherein, when in the first configuration, the first pump system and the drilling apparatus are located on a first well pad of the well pads and the second pump system is located on a second well pad of the well pads that is different from the first well pad;

wherein, when in the first configuration, the first pump system and the drilling apparatus are capable of performing a first drilling operation on a first well on the first well pad;

wherein, when in the second configuration, the drilling apparatus is operably coupled to the second pump system at the second well pad and the completion unit is operably coupled to the first pump system;

wherein, when in the second configuration, the second pump system and the drilling apparatus are capable of performing a second drilling operation on a second well on the second well pad that is different from the first well pad; and wherein, when in the second configuration, the first pump system and the completion unit are capable of performing a first completion operation on the first well on the first well pad.

14. The system of claim 13, wherein, when in the second configuration, the second pump system and the drilling apparatus perform the second drilling operation on the second well on the second well pad and the first pump system and the completion unit perform the first completion operation on the first well on the first well pad simultaneously.

15. The system of claim 13, wherein the drilling apparatus comprises a drilling apparatus controller;

wherein the drilling apparatus controller is configured to save drilling data generated during the first drilling operation on the first well;

wherein the completion unit comprise a completion controller; and wherein the completion controller is configured to create a first well completion program using the drilling data generated during the first drilling operation on the first well;

wherein the completion controller is configured to execute first well completion program.

16. The system of claim 15, wherein the completion unit further comprises a sensor monitoring a completion parameter associated with the first completion operation;

wherein the completion controller is capable of controlling the operation of the first pump system when the drilling and completion system is in the second configuration;

wherein the first well completion program comprises a target parameter; and wherein the completion unit controller, when the drilling and completion system is in the second configuration and when the first pump system and the completion unit are performing the first completion operation, is capable of:

receiving the completion parameters from the sensor;

determining a difference between the completion parameter and the target parameters; and generating control signals, based on the difference, for the first pump system to reduce the difference such that the completion unit controller, the sensor, and the first pump system form a closed loop system when in the drilling and completion system is in the second configuration.

17. The system of claim 16, wherein the first completion operation comprise a wireline pump down;

wherein the completion unit comprises a wireline unit;

wherein the sensor is a plurality of sensors;

wherein the plurality of sensors monitor one or more of line speed of the wireline unit, depth, or line tension such that the completion parameters comprise one or more of: line speed of the wireline unit, depth, or line tension;

wherein the target parameter is one of a plurality of target parameters; and wherein the plurality of target parameters comprise one or more of a target line speed of the wireline unit, a target depth, or a target line tension.

18. The system of claim 17, wherein drilling data generated during the first drilling operation on the first well comprises a curve in a wellbore associated with specific wellbore depth; and wherein the first well completion program comprises target parameters based on the curve in the wellbore associated with the specific wellbore depth.

19. The system of claim 16, wherein the first completion operation comprise a leak off test.

20. The system of claim 19, wherein the sensor monitors a wellbore pressure; and wherein target parameter comprises a target test pressure.

21. The system of claim 13, further comprising:

wherein the drilling and completion is capable of being positioned in a third configuration and a fourth configuration on the second well pad and a third well pad;

wherein, when in the third configuration, the drilling apparatus is operably coupled to the second pump system at the second well pad; and wherein, when in the third configuration, the second pump system and the drilling apparatus is capable of performing a third drilling operation on a third well on the second well pad;

wherein, when in the fourth configuration, the drilling apparatus is operably coupled to the first pump system at the third well pad;

wherein, when in the fourth configuration, the completion unit is operably coupled to the second pump system at the second well pad; and wherein, when in the fourth configuration, the first pump system and the drilling apparatus perform a fourth drilling operation on a fourth well on the third well pad while simultaneously the second pump system and the completion unit perform a second completion operation on the third well at the second well pad.

22. The system of claim 21, wherein use of the first pump system and the second pump system in completion operations and drilling operations reduces or eliminates delivery, to a well site associated with one of the first, second, or third well pads, of high-volume well stimulation pumps via heavy trucks and thereby reduces greenhouse gas emissions.

* * * * *